US006336443B1

(12) United States Patent
Hlousek

(10) Patent No.: US 6,336,443 B1
(45) Date of Patent: Jan. 8, 2002

(54) INJECTION PUMP

(75) Inventor: Jaroslaw Hlousek, Golling (AT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/553,620

(22) Filed: Apr. 20, 2000

(30) Foreign Application Priority Data

Apr. 29, 1999 (DE) ..... 199 19 430

(51) Int. Cl.[7] ..... F02M 37/04
(52) U.S. Cl. ..... 123/495; 123/501; 417/490
(58) Field of Search ..... 123/495, 501, 123/468, 500; 417/490, 494, 493, 499

(56) References Cited

U.S. PATENT DOCUMENTS 1,958,948 A * 5/1934 Knecht ..... 417/494
2,007,871 A * 7/1935 Oldham ..... 417/494
RE20,573 E * 12/1937 L'orange ..... 417/494
2,131,228 A * 9/1938 L'orange ..... 417/494
3,179,053 A * 4/1965 Jordan ..... 417/494
3,737,258 A * 6/1973 Krauja et al. ..... 123/139 AR
4,490,098 A * 12/1984 Freudenschuss et al. .... 417/499
4,811,716 A * 3/1989 Guntert et al. ..... 123/503
5,209,208 A * 5/1993 Siebert et al. ..... 123/503
5,322,423 A * 6/1994 Heck et al. ..... 417/490
5,839,414 A * 11/1998 Klinger et al. ..... 123/467

* cited by examiner

*Primary Examiner*—Henry C. Yuen
*Assistant Examiner*—Mahmoud Gimie
(74) *Attorney, Agent, or Firm*—Ronald E. Greigg

(57) ABSTRACT

An injection pump for generating high fuel pressure in fuel injection systems of internal combustion engines, having a pump piston, which reciprocates in a cylinder having a control bore in order to aspirate fuel from a suction chamber into a high-pressure chamber and act upon the fuel with high pressure. The supply onset of the injection pump is defined by when an upper control edge, which is embodied on the pump piston and is oriented toward the high-pressure chamber passes the control bore, and the end of supply by the injection pump is defined by when a lower control edge, which is embodied on the pump piston and is remote from the high-pressure chamber, passes the control bore. The invention sets forth an injection pump in which the supply onset can be set freely for two different operating modes of the engine. The supply onset is attained in the cylinder by use of a second control bore, which cooperates with a plunge cut in the cylinder and with a piston stop groove that extends longitudinally along the pump piston from the upper control edge.

3 Claims, 1 Drawing Sheet

INJECTION PUMP

BACKGROUND OF THE INVENTION

The invention relates to an injection pump for generating high fuel pressure in fuel injection systems of internal combustion engines, having a pump piston, which can reciprocate in a cylinder having a control bore in order to aspirate fuel from a suction chamber into a high-pressure chamber and act upon the fuel with high pressure. A supply onset of the injection pump is defined by when an upper control edge, which is embodied on the pump piston and is oriented toward the high-pressure chamber passes the control bore, and the end of supply by the injection pump is defined by when a lower control edge, which is embodied on the pump piston and is remote from the high-pressure chamber, passes the control bore.

In conventional in-line injection pumps, the supply onset is defined by the closure of the control bore by the piston control edge located at the top. If the piston control edge is embodied obliquely and located at the top, the supply onset can be defined by rotating the pump piston as a function of a motion of a control rod. In this so-called load-dependent injection adjustment, the control path for the injection quantity and the supply onset is fixedly assigned. It is known that a shift in the injection onset closer to top dead center of the engine piston brings about a marked reduction in NOx emissions. However, this also causes a slight increase in fuel consumption.

OBJECT AND SUMMARY OF THE INVENTION

An object of the invention is to furnish an injection pump in which the supply onset can be set freely for two different operating modes of the engine.

This object is attained in an injection pump for generating high fuel pressure in fuel injection systems of internal combustion engines. The system includes a pump piston, which can reciprocate in a cylinder having a control bore in order to aspirate fuel from a suction chamber into a high-pressure chamber and act upon the fuel with high pressure. A supply onset of the injection pump is defined by when an upper control edge, which is embodied on the pump piston and is oriented toward the high-pressure chamber passes the control bore and the end of supply by the injection pump is defined by when a lower control edge, which is embodied on the pump piston and is remote from the high-pressure chamber, passes the control bore. The cylinder has a second control bore, which cooperates with a plunge cut in the cylinder and with a piston stop groove that extends longitudinally along the pump piston from the upper control edge. The end of supply by the injection pump is always controlled by the lower control edge. By means of the second control bore, a second supply onset is made possible. Once the upper control edge has closed off the associated control bore, the fuel positively displaced by the pump piston can still flow out through the second control bore until such time as the end of the piston stop groove has moved past the top edge of the cylinder plunge cut.

A particular embodiment of the invention is characterized in that the two control bores can be made to communicate in the cylinder with one another and with the suction chamber via a 3/2-way valve. With the 3/2-way valve, a switchover from the first supply onset to the second supply onset can be made. This expands the optimal operating range of the engine. Via a governor, automatic switching from the "economy" operating mode to the "low NOx emissions" operating mode is possible.

A further particular embodiment of the invention is characterized in that the lower control edge is embodied obliquely. The oblique embodiment of the lower control edge that defines the end of supply offers the advantage, over a control edge extending perpendicular to the longitudinal axis of the piston, that by means of a defined rotation of the pump piston, the same useful stroke can nevertheless be attained despite a different supply onset.

The invention will be better understood and further objects and advantages thereof will become more apparent from the ensuing detailed description of a preferred embodiment taken in conjunction with the drawing. The characteristics recited in the claims and in the description can each be essential to the invention individually or in arbitrary combination.

DESCRIPTION OF THE PREFERRED EMBODIMENT

Figure 1:
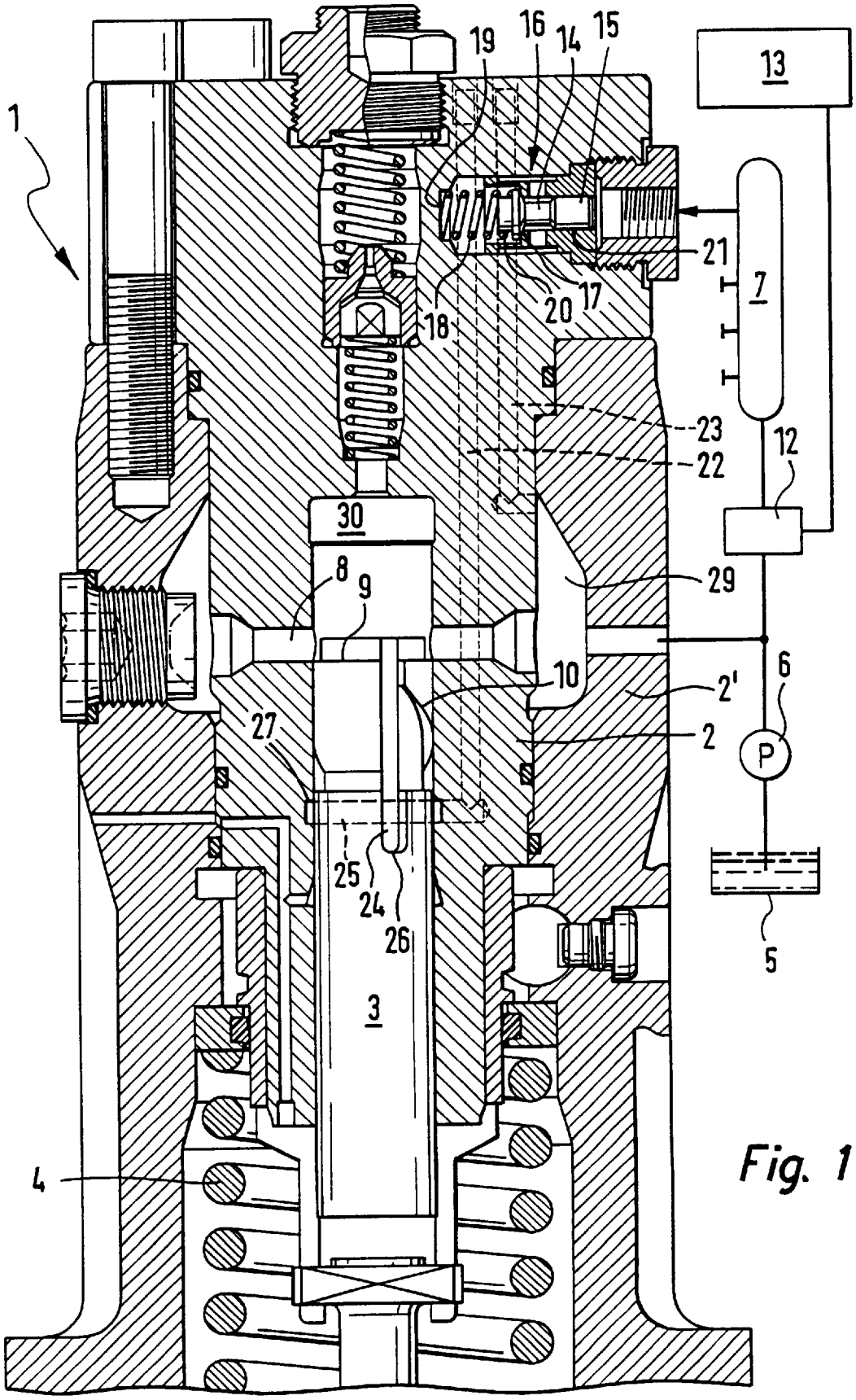
FIG. 1 shows a detailed cross sectional view of a pump element of an in-line injection pump.

In FIG. 1, a detail of a pump element 1 of an in-line injection pump is seen. A pump piston 3 is received in a cylinder 2 which is fixed in a housing 2' in such a way that the piston can reciprocate. The pump piston 3 is moved in the pumping direction by a camshaft driven by the engine and is retracted by a piston spring 4. The stroke of the pump piston 3 is invariable. One opportunity for regulating the supply quantity is obtained by varying the useful stroke, which is brought about by simultaneously rotating all the pump pistons using a displaceable control rod. The pump piston 3 upon each revolution executes the full stroke, including an intake stroke and a compression stroke. The metering of the supply quantity is effected by the edge control at the pump piston 3. The fuel to be pumped is pumped out of a fuel tank 5 by a prefeed pump 6 into a reservoir 7.

A control bore 8 is disposed transversely to the longitudinal axis of the cylinder 2. Cooperating with the control bore 8 is an upper control edge 9, which is embodied on the pump piston 3. The upper control edge 9 controls the supply onset. Once the upper control edge 9 has moved past the upper edge of the control bore 8, the fuel contained in the high-pressure chamber 30 is acted upon by pressure until such time as an oblique lower control edge 10 reaches the lower edge of the control bore 8. The lower control edge 10 controls the end of supply.

If a valve 12, electronically controlled by a governor 13, opens, then fuel flows via the reservoir 7 to a 3/2-way valve 16. In the closed state of the 3/2-way valve 16, a conical seat 17 embodied on a valve piston 14 is held in contact with the valve housing by the prestressing force of a valve spring 18. In the closed state of the 3/2-way valve 16, no fuel can flow out of a second control bore 22 into a drainage bore 23 that communicates with the suction chamber 29. When the piston face 15 of the valve piston 14 is acted upon by the fuel pressure, the 3/2-way valve 16 opens, and the valve piston 14 comes into contact with a stop 19. In the open state of the 3/2-way valve 16, the second control bore 22 communicates with the suction chamber 29 via the drainage bore 23. In this state, the fuel located in the high-pressure chamber 30 can flow, via a piston stop groove 24 embodied on the circumference of the pump piston 3, into the second control bore 22 and from there can flow via the 3/2-way valve 16 into the drainage bore 23, which communicates with the suction chamber 29. A cylinder plunge cut 25 is embodied in the cylinder 2 at the orifice point of the second control bore 22. The fuel from the piston stop groove 24 passes via the cylinder plunge cut 25 into the second control bore 22. The time when the end 26 of the piston stop groove 24 moves past the upper edge 27 of the cylinder plunge cut 25 represents the supply onset. The end of supply is controlled by the oblique lower control edge 10.

In the "economy" mode, the 3/2-way valve 16 remains closed, thanks to the valve spring 18. The upper control edge 9 of the pump piston 3 controls the supply onset, while the lower control edge 10 controls the end of supply.

In the "low NOx emissions" mode, the valve piston 14 of the 3/2-way valve 16 is acted upon, on its face end 15, by the fuel pressure as a result of the opening of the electronically controlled valve 12. The valve piston 14 is moved as far as the stop 19. In this process, the conical seat 17 opens. The 3/2-way valve 16 remains in pressure equilibrium in the open state as well, because the diameters 20 and 21 of the valve piston 14 are the same.

The supply onset by the pump is controlled in this position of the valve piston 14 by the lengthened piston stop groove 24 and by the cylinder plunge cut 25. Although the upper control edge 9 has in fact already closed the control bore 8, the fuel positively displaced by the pump piston 3 still flows back into the suction chamber 29 through the bores 22 and 23 until the end 26 of the piston stop groove 24 has moved past the upper edge 27 of the plunge cut.

The end of supply is also controlled with the lower control edge 10. In the adjustment of the supply onset, the pump piston 3 is rotated in a suitable way, so that the same useful stroke can be attained despite a different supply onset. The optimal operating range of the large diesel engine is expanded by this simple "switch function".

The foregoing relates to a preferred exemplary embodiment of the invention, it being understood that other variants and embodiments thereof are possible within the spirit and scope of the invention, the latter being defined by the appended claims.

I claim:

1. An injection pump for generating high fuel pressure in fuel injection systems of internal combustion engines, comprising a pump piston (3), the pump piston reciprocates in a cylinder (2) having a control bore (8) in order to aspirate fuel from a suction chamber (29) into a high-pressure chamber (30) and act upon the fuel with high pressure, the supply onset of the injection pump is defined by when an upper control edge (9), which is embodied on the pump piston (3) and is oriented toward the high-pressure chamber (30) passes the control bore (8), and the end of supply by the injection pump is defined by when a lower control edge (10), which is embodied on the pump piston (3) and is remote from the high-pressure chamber (30), passes the control bore, the cylinder (2) has a second control bore (22), which cooperates with a plunge cut (25) in the cylinder and with a piston stop groove (24) that extends longitudinally along the pump piston (3) from the upper control edge (8).

2. The injection pump according to claim 1, in which the two control bores (8, 22) are made to communicate in the cylinder (2) with one another and with the suction chamber (29) via a 3/2-way valve (16).

3. The injection pump according to claim 1, in which the lower control edge (10) is embodied obliquely.

* * * * *